US006230339B1

(12) United States Patent
McCrink

(10) Patent No.: US 6,230,339 B1
(45) Date of Patent: May 15, 2001

(54) LIFT ASSISTING DEVICE

(76) Inventor: Frank P. McCrink, 17 Margaretta Rd., Boonton, NJ (US) 07005

( * ) Notice: Subject to any disclaimer, the term of this patent is extended or adjusted under 35 U.S.C. 154(b) by 0 days.

(21) Appl. No.: 09/477,614

(22) Filed: Jan. 4, 2000

(51) Int. Cl.[7] ..... A47K 3/12
(52) U.S. Cl. ..... 4/576.1; 4/559
(58) Field of Search ..... 4/559, 571.1, 573.1, 4/576.1, 577.1, 578.1, 579, 604, 611

(56) References Cited

U.S. PATENT DOCUMENTS

| | | | | |
|---|---|---|---|---|
| 345,918 | * | 7/1886 | Palmer | 4/559 |
| 647,160 | * | 4/1900 | Silver | 4/579 |
| 1,827,575 | * | 10/1931 | Germershausen | 4/576.1 |
| 2,059,171 | * | 10/1936 | Harris | 4/576.1 |
| 2,514,743 | * | 7/1950 | Carson | 4/559 |
| 3,228,038 | * | 1/1966 | Augustine | 4/576.1 |

FOREIGN PATENT DOCUMENTS

| | | | | |
|---|---|---|---|---|
| 943137 | * | 11/1963 | (GB) | 4/576.1 |

* cited by examiner

*Primary Examiner*—Robert M. Fetsuga
(74) *Attorney, Agent, or Firm*—Edward Goldberg

(57) ABSTRACT

A lift assisting device includes a longitudinal extension member having two angled arms extending outwardly from a wall. The arms are joined together at the wall end to form a loop which pivotally and tightly engages a tubular bar mounted along the wall. The other ends of the arms engage a handle which can be grasped by a person to pull up from a sitting position or lower down from a standing position. The extension member can maintain a longitudinal position extending from the wall or a vertical position along the wall. The preferred use of the extension member is for safely lowering into or rising from a bathtub with the device extending from a wall at the head of the tub.

12 Claims, 1 Drawing Sheet

LIFT ASSISTING DEVICE

BACKGROUND OF THE INVENTION

1. Field of the Invention

The present invention relates to a simplified device which assists a person in rising safely from a sitting position on a low surface such as a bathtub or in sitting down from a standing position.

2. Description of the Prior Art

Devices for assisting persons to pull themselves up from a low sitting position or in sitting down from a standing position such as in a bathtub have been used in the past. Examples of such known devices are described below.

U.S. Pat. No. 2,059,171 to Harris shows a longitudinal handle having one end pivotally secured on a wall above a bathtub and a ring at the other end for grasping by the hand of a person for support in sitting down and rising from the tub. The handle can pivot to a vertical position against the wall.

U.S. Pat. No. 3,228,038 to Augustine concerns a safety bar having ends pivotally mounted on a wall at the end of a bathtub. The bar is in the form of a long low U-shaped handle extending from the wall and resting on the sides of the tub with vertical side members and a horizontal bar across the tub for a person to hold onto in getting into and out of the tub.

U.S. Pat. No. 4,437,196 to Louis shows a hydraulic jack mounted on support bars secured to the wall at the end of a bathtub. A handle attached to the jack is held by a person in the tub to assist in getting up and out of the tub.

U.S. Pat. No. 5,050,252 to Cuttriss depicts a grab bar having a straight central portion and angled ends mounted on an end wall over a tub. The ends are rotatable in end holders bolted to the wall.

The various previous devices have had shortcomings in either being too complex, being secured in a position too low or of an improper length to provide adequate leverage for easily pulling up to a full standing position or safely lowering to a sitting position, not permitting a two handed grip, not being readily detachable, or not having the capability of being held in an extended position.

SUMMARY OF THE INVENTION

It is therefore the primary object of the present invention to provide a simplified self lifting device for assisting a person in rising safely from a low sitting position to a standing position or lowering to a sitting position.

It is another object of the present invention to provide a lift assisting device secured at a sufficient height and of a sufficient length to permit a person to easily pull up to a standing position or lower to a sitting position and to avoid slipping and possible injury.

An additional object of the invention is to provide a two handed grip for a self lifting device which is particularly useful in assisting a person to stand up or sit down in a bathtub.

It is also an object of the invention to provide a self lifting device coupled to a wall bar at the head of a bathtub and which includes a stop member to maintain a desired extended position.

Still another object of the invention is to provide a self lifting device coupled to a wall bar which includes a tension adjusting member to maintain a desired position.

A further object of the invention is to provide a self lifting device which is pivotally mounted over a bathtub and which can be raised out of the way when not in use.

Yet another object of the invention is to provide a lift assisting device for a bathtub which is readily engageable with a wall bar and readily disengaged from the wall bar.

These objects are achieved with a novel elongated U-shaped bar or tube laterally mounted and secured at each end to a wall at the head of the bathtub. A unitary bifurcated extension member has a narrow end which pivotally engages the wall bar and has two angled arms extending outwardly to a cross-wise handle engaging the other end of the arms. The handle provides a grip for a person when rising from or lowering into the tub. The arms at the end of the device that pivotally engages the wall bar are joined together in a loop that fits tightly over and snaps around the wall bar. A tension member or a stop member may be positioned adjacent the wall bar to engage the loop and hold the device in an extended position when in use. The device may be pivoted to a vertical position against the wall when not in use. Other objects and advantages will become apparent from the following description in conjunction with the accompanying drawings.

DESCRIPTION OF THE PREFERRED EMBODIMENTS

Figure 1:
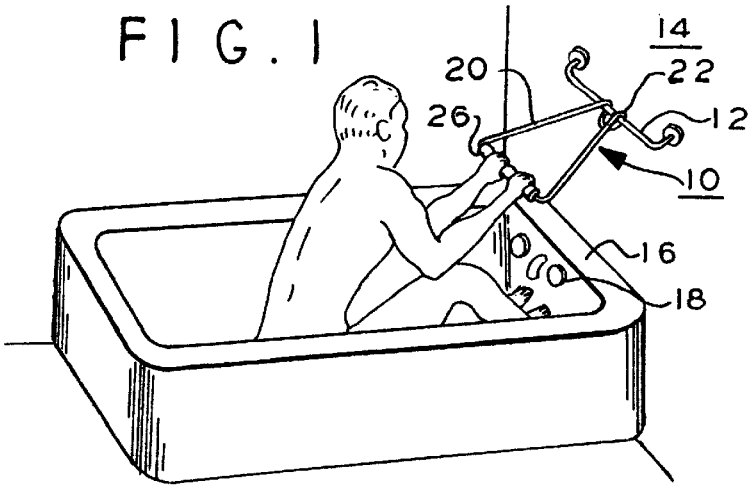
FIG. 1 is an isometric side view showing the lift assisting device having a closed looped end engaging a wall bar at the head of a bathtub with a person sitting in the tub and holding the handle at the other end of the longitudinally extending angled arms.

As shown in FIG. 1, the lift assisting device 10 includes a sturdy elongated U-shaped round metal tube or bar 12, preferably of stainless steel, mounted securely on wall 14 in a horizontal position above the head of bathtub 16 and above the water control knobs 18. The height above the floor is preferably about three feet to provide a hand rail for a person of average height to hold to easily and safely enter and exit the tub in cooperation with the extending portions of the device to assist in pulling themselves up from a sitting position in the tub or permit easy and safe lowering from a standing position. The ends of tube 12 should be screwed to studs behind the wall which are generally spaced about sixteen inches apart or may be mounted with proper wing bolts.

Figure 2:
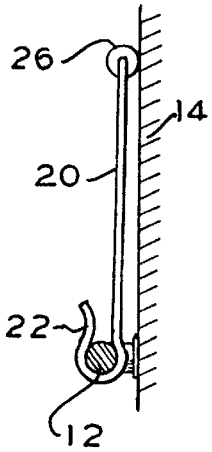
FIG. 2 is a side view of the lift assisting device showing the looped end around the wall bar and extending arms and handle in an upright stored position against the wall.

Extending from a central portion of tube 12 is an elongated unitary bifurcated extension member having angled arms 20 about twelve to eighteen inches long and extending longitudinally from the wall bar at a downward angle over the tub to be within reach of an average person. The extension member is of a solid sturdy aluminum, stainless steel or other non-rusting metal. It may be about 5/16 inch in diameter so that it is resistant to bending. The arms 20 are joined together in a narrow looped end 22 pivotally engaging and snapping onto tube 12 with the loop extending over, around and under the wall bar in a relatively tight fit which normally is sufficient to permit the device to be held in an extended position over the tub when being used. The looped end may also be provided with a rubber coating to grip tube 12 more firmly. As shown in FIG. 2, when not in use the arms 20 are raised in a vertical position to be held against the wall at the head of the tub out of the way. The loop end of the device may also be adjusted to move to any desired horizontal position along tube 12 and wall 14.

Figure 3:
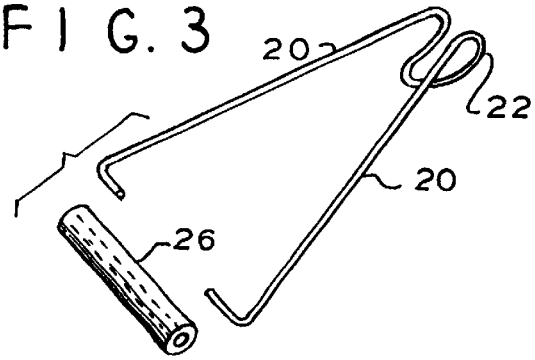
FIG. 3 is an isometric side view of the lift assisting device disassembled from the handle.

At the other end of arms 20 is a handle 26 for a person to grip with both hands when lowering into the tub in a sitting position or when pulling up to a standing position. As shown in FIG. 3, the arms 20 have inwardly bent ends which fit into and engage the open ends of handle 26. The handle is longer than the spacing between the bent ends and the arms are resilient and must be pulled apart to permit the ends to snap into the handle openings. This provides a secure connection for the handle and arms. The handle is preferably formed of a metal tube with a ribbed rubber covering.

Figure 4:
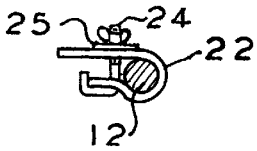
FIG. 4 is a partial side cross sectional view showing the looped end engaging a wall bar with a clamp providing an adjustable tension for holding the device in a desired position.

As shown in FIG. 4, a tension adjusting J-bolt or clamp 24, passes through a hole in a plate 25 on the upper portion of loop 22 and under and around the lower looped end to further tighten the device about the wall bar to maintain the desired position.

Figure 5:
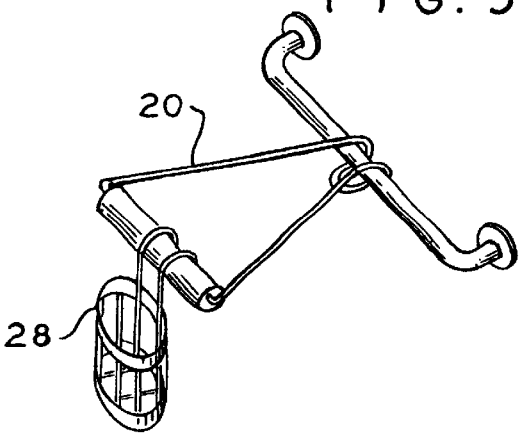
FIG. 5 is an isometric side view showing an accessory tray supported at the extended handle end of the device.
Figure 6:
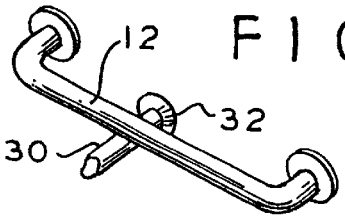
FIG. 6 is an isometric view of a stop member for holding the lift assisting device in an extended position.
Figure 7:
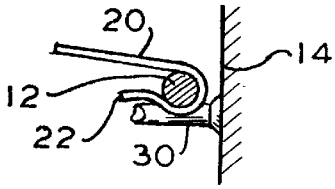
FIG. 7 is a partial side sectional view of the stop member, wall bar and looped end in an intermediate position.
Figure 8:
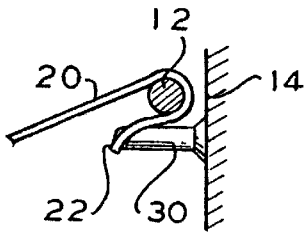
FIG. 8 is a partial side sectional view of the stop member holding the looped end in an extended position.
Figure 9:
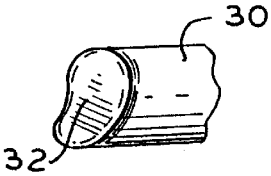
FIG. 9 is an isometric side view of the end of the stop member showing a concave surface which engages the looped end to hold the lift assisting device in the extended position.

As shown in FIG. 5, an added accessory tray 28 may be hung around the handle to hold soap, shampoo or other items used in bathing. FIG. 6 shows an added stop member 30 in the form of a cylindrical bar or rod mounted on the wall at a close spacing and extending below the wall bar 12. The stop may be held on the wall by a suction cup 32 or a more permanent mounting. FIG. 7 shows the looped end 22 around wall bar 12 with arm 20 in an intermediate extended position and stop member positioned to engage the looped end. As shown in FIG. 8, the inner surface of looped end 22 engages a groove 32 at the end of stop 30 to prevent further downward movement of the extended arm 20. The stop provides a more positive limit to hold the arms and handle in a desired extended position. FIG. 9 shows the end of the stop including the groove 32 which receives the looped end 22 to maintain the position.

When in use, the height of the wall mounted bar or tube 12 and the length of the pivotable extended arms 20 with handle 26 provides sufficient leverage to assist a person of average height, reach and weight to safely and easily lower themselves into a tub and also pull up from a sitting to a standing position. The arms and loop end pivot about the wall bar and move up and down with the movement of the person pulling on the handle when rising from or lowering into the tub. In order to achieve the optimum leverage, the person's feet must rest firmly against the bottom of the front tub wall while pulling on the handle. Although primarily designed for use in bathtubs, the lift assisting device may also find use as a wall mounted exercise device.

While only a single embodiment has been illustrated and described, variations may be made in the particular configuration without departing from the scope of the invention as set forth in the appended claims.

What is claimed is:

1. A lift assisting device comprising:

a tubular bar mounted and extending horizontally along a wall, a unitary longitudinal extension member having two angled arms extending outwardly from said bar, said arms having one narrow end joined together in a loop passing over around and under said bar and pivotally engageable therewith, said loop engaging said bar in a relatively tight fit permitting pivotal movement about said bar while maintaining a set position, the other ends of said angled arms being spaced apart, and a crosswise handle having two opposite ends secured to said two arms at the other spaced ends.

2. The device of claim 1 wherein the other ends of said arms are bent inwardly, said handle being tubular and having end openings engageable with said bent arms ends.

3. The device of claim 2 wherein said arms are resilient and said handle is of a length to engage said arms in a snap fit.

4. The device of claim 2 including stop means mounted on said wall and extending under said bar, said stop means being engageable with said loop end passing under said bar to hold said arms and handle in an outwardly extending longitudinal position.

5. The device of claim 2 wherein said tubular bar is mounted on a wall above the head of a bathtub, said arms and handle being pivotable about said bar between a position extending longitudinally over and along said bathtub and a vertical position along said wall.

6. The device of claim 5 wherein said handle provides a two handed grip for a person lowering into the tub from a standing position and rising in the tub from a sitting position.

7. The device of claim 3 wherein said handle is a metal tube having a rubber covering.

8. The device of claim 6 including an accessory tray supported on said handle.

9. The device of claim 4 wherein said stop means has a grooved end engaging said loop end.

10. The device of claim 4 wherein said looped end of said arms is disengageable from said bar.

11. The device of claim 10 wherein said handle is disengageable from said arms.

12. The device of claim 2 including tension adjusting means extending from the upper portions of said loop adjacent said bar and under the lower end of said loop for tightening said loop around said bar.

* * * * *